US006997701B2

(12) United States Patent
Volkert et al.

(10) Patent No.: US 6,997,701 B2
(45) Date of Patent: Feb. 14, 2006

(54) BURNER FOR A GAS AND AIR MIXTURE

(75) Inventors: Jochen Volkert, Pommelbrunn (DE); Peter Goebel, Frankenberg (DE)

(73) Assignee: GVP Gesellschaft zur Vermarketing der Porenbrennertechnik mbH, Erlangen (DE)

( * ) Notice: Subject to any disclaimer, the term of this patent is extended or adjusted under 35 U.S.C. 154(b) by 169 days.

(21) Appl. No.: 10/473,024

(22) PCT Filed: Mar. 25, 2002

(86) PCT No.: PCT/EP02/03342

§ 371 (c)(1),
(2), (4) Date: Sep. 25, 2003

(87) PCT Pub. No.: WO02/077525

PCT Pub. Date: Oct. 3, 2002

(65) Prior Publication Data

US 2004/0091831 A1 May 13, 2004

(30) Foreign Application Priority Data

Mar. 26, 2001 (DE) ..... 101 14 903

(51) Int. Cl.
*F23D 14/14* (2006.01)

(52) U.S. Cl. ..... 431/326; 431/346

(58) Field of Classification Search ..... 431/326, 431/328, 329, 346, 347, 350
See application file for complete search history.

(56) References Cited

U.S. PATENT DOCUMENTS

| | | | | |
|---|---|---|---|---|
| 3,088,271 A | | 5/1963 | Smith | |
| 3,216,478 A | * | 11/1965 | Saunders et al. | 431/329 |
| 3,324,924 A | * | 6/1967 | Hailstone et al. | 431/328 |
| 3,936,003 A | * | 2/1976 | Hapgood et al. | 431/354 |
| 4,519,770 A | * | 5/1985 | Kesselring et al. | 431/328 |
| 4,679,528 A | * | 7/1987 | Krans et al. | 431/328 |
| 4,889,481 A | * | 12/1989 | Morris et al. | 431/328 |
| 4,900,245 A | | 2/1990 | Ahmady | |
| 5,147,201 A | | 9/1992 | Xiong | |
| 5,240,411 A | | 8/1993 | Abalos | |
| 5,249,953 A | | 10/1993 | Roth | |
| 5,522,723 A | | 6/1996 | Durst et al. | |

FOREIGN PATENT DOCUMENTS

DE 43 22 109 A1 1/1995

* cited by examiner

*Primary Examiner*—Sara Clarke
(74) *Attorney, Agent, or Firm*—Rankin, Hill, Porter & Clark LLP

(57) ABSTRACT

A burner for a gas/air mixture with an inlet (2) for the gas/air mixture, wherein a jet tube (7) is located downstream of the inlet (2). The jet tube (7) has a jacket surface with a plurality of breakthroughs (8) and is surrounded radially a flame stabilizing device.

21 Claims, 4 Drawing Sheets

BURNER FOR A GAS AND AIR MIXTURE

BACKGROUND OF THE INVENTION

The invention relates to a burner for a gas/air mixture.

In accordance with state of art, a burner for a gas/air mixture is known from DE 43 22 109 A1, for instance. Combustion takes place axially in a housing with constant cross section which is totally filled with a porous material. No flame front extends beyond the porous material. The combustion takes place exclusively within the space filled with the porous material. No free flames are generated which extend to the surroundings from an exterior surface or boundary surface of the porous material. This is also called a volume burner. The known burner can be used to burn a gas/air mixture with low emission values.

From JP 59195022 A (patent abstracts of Japan) a burner is known in which a tube with breakthroughs is radially surrounded with a cylinder body made of catalytic material. This is a surface burner, i.e., the flames extend from a surface to the surroundings.

U.S. Pat. No. 4,900,245 describes an infrared burner device on which a jet tube is surrounded by a cylindrical element which is made of a ceramic foam. The cylindrical element is used for the uniform distribution of the gas on its surface. The gas is burned on the surface of the cylindrical element. A flame detector is installed on the surface. When the flame goes out, another ignition follows automatically.

DE 195 08 908 A1 describes a burner pipe on which a plurality of circumferential radial slits is present. The flames exit in the shape of a fan from the slits.

A gas burner is known from GB 2 231 949 A. A combustible gas mixture is fed through a porous ceramic disk and burned. The disk can be located in the direction of current after a layer consisting of flat and rippled ring disks. In this case, the gas is burned on an outer surface surrounding the layer sequence.

EP 0 382 674 describes an infrared burner on which a porous layer made up of ceramic fibers is located on a cylinder made of wire mesh. This is also a surface burner. Other surface burners are known from DE 297 15 119 41 or U.S. Pat. No. 4,679,528, for example.

BRIEF SUMMARY OF THE INVENTION

The object of the invention is to remove the disadvantages as permitted by state of art. In particular, a volume burner should be provided which offers improved heat decoupling and, with this, burning of a gas/air mixture with low emission values is possible at the same time. An additional goal is to show a volume burner whose modulation capability is improved over known volume and surface burners.

According to the invention, there is provided a burner for a gas/air mixture with an inlet for the gas/air mixture wherein there is provided a jet tube located downcurrent from the inlet, the jet tube having a jacket surface with a plurality of breakthroughs and wherein the jet tube is radially surrounded by a means for stabilising the flame. The means for stabilising the flame defines the combustion space or a volumetric combustion zone.

The burner in accordance with the invention has excellent heat decoupling. This is caused by an improved heat transfer due to convection and radiation. A gas/air mixture can be burned with particularly low emission values due to the improved homogenisation over the total modulation area.

The term "gas/air mixture" in this case is understood to mean a mixture consisting of a combustible gas, e.g., natural gas, propane gas and similar with air or another suitable oxidation agent, wherein the mixture ratio is selected so that combustion is possible.

The diameter of the breakthroughs in the jet tube is selected so that a flame backfire in the jet tube is not possible. The breakthroughs can have a diameter from 0.5 to 2.0 mm, preferably 1.3 to 1.5 mm.

The combustion of the gas occurs primarily in the means of stabilising the flame. In particular, no free flames are created on the outer surface surrounded by the means of stabilising the flame. The function of the flame-stabilisation means is to limit the combustion space and, at the same time, to even out and lower the flame temperature. Another function is the stabilisation of the flame in the transition area between jet tube and the combustion space by gradually increasing the Péclet number. The flame-stabilisation means is not immediately surrounded by a housing. The heat can be decoupled without hindrance. Due to the radial arrangement of the flame-stabilisation means, a particularly large area for heat decoupling is achieved. The decoupling area can, for instance, be the area of a cylinder jacket. The radial arrangement of the means for stabilisation of the flame also has the advantage that the expanding combustion gases can be quickly vented by a radial to the exterior increasing volume on communicating current canals. No heat build-up is created in the flame-stabilisation means which further improves the heat decoupling. Due to the radial expansion of the cross sections of the current canals caused by the radial arrangement of the flame-stabilisation means, the convection speed of the combustion gases slows. The flame is then stabilised further by the mechanical flow. The modulation capability of the burner is further increased.

Advantageously a blower is positioned after the inlet for transportation of the gas/air mixture to the jet tube. This ensures that a sufficient amount of gas/air mixture is always fed through the jet tube to the flame-stabilisation means.

The jet tube can be made of fireproof ceramics which is preferably made of ceramic fibers. The fireproof ceramic material has a porosity of 75 to 95 vol. %. In actual practice, such ceramic material is known for its long life. In particular a ceramic material made of ceramic fibers has a long service life due to its particularly strong resistance to breaking. The ceramics are composed of approximately 50 weight % aluminium oxide and 50 weight % silicon oxide.

Naturally, the jet tube can also be made of other suitable materials, e.g., heat resistant metals, quartz glass, glass ceramics, foam ceramics and similar.

The flame-stabilisation means can be a porous medium with a pore size which permits the generation of a flame.

According to a useful embodiment the flame-stabilisation means is created from a plurality of ring disks arranged radially from the jet tube and with an axial distance from one another. The ring disks can be held frictionally engaged on the jet tube.

The ring disks can be made from first and second ring disks, wherein a ring radius of the first ring disk is smaller than the ring radius of the second ring disk. According to a useful embodiment the ring radius of the second ring disk is at least twice as large as the ring radius of the first ring disk. In this context the term "ring radius" is used to mean the difference between an inner radius and an outer radius of the ring disk.

In accordance with a further embodiment, the first and the second ring disks are positioned alternately in axial direction on the jet tube. Alternation of the first and the second ring disks creates advantageously a radially inner first flame stabilisation zone as well as a radially outer second flame stabilisation zone without first ring disks in between. The Péclet number of the first flame stabilisation zone can be smaller than the Péclet number of the second flame stabilisation zone. The suggested increase in the Péclet number from inside to outside is not continuous in the stated example. Surprisingly it was shown that already the provision of two flame stabilisation zones make possible the implementation of a burner with excellent dynamics.

Naturally, it is also possible to implement a sequence of a plurality of flame stabilisation zones in the flame-stabilisation means. Ideally, the Péclet number increases continuously radially from the inside to the outside. The Péclet number is always selected so that combustion in accordance with the type of volume burner takes place in the flame-stabilisation means. In contrast, the Péclet number of the jet tube is selected so that a flame backfire in the jet tube is not possible. Due to the definition of the Péclet number and how volume burners work and function, DE 43 22 109 A1 is also pointed out whose disclosures are thereby included herein.

According to a useful embodiment the area of the ring disks is rippled so that current flow canals are created between two adjacent ring disks from the jet tube to the outer circumference edge of the ring disks. The wave crest lines of the ripples run, preferably bent, from the centre to the circumference edge of the ring disks so that continuous current flow canals are created, preferably bent, between two adjacent ring disks from the jet tube to the outer circumference edge of the ring disks.

In accordance with a further embodiment, current canals are created in the stabilisation means whose cross section increases radially from the inside to the outside. The Péclet number increases in the stabilisation means radially towards the outside. It has been shown that such a formation creates a particularly strong decoupling of the heat generated by the combustion as well as an increase in the modulation capability. In addition it has been shown that noise emission caused by thermo-acoustic excitation can be significantly decreased by the radial increase of the cross section from the inside to the outside. The suggested burner is particularly quiet during operation. In particular, there are no low-frequency oscillations which could destroy the jet tube or the flame-stabilisation means.

The area of the ring disks has a plurality of additional breakthroughs. The additional breakthroughs can be square, slit-like or round. The opening area of the additional breakthroughs is approximately 1 $mm^2$. The ring disks can be made of fireproof ceramics, preferably with a mesh-type structure. This can be a textile made of mullite fibers which is contained in a matrix made of aluminium oxide.

Based on a further embodiment feature, the ring disks are arranged between two additional ring disks made of fireproof ceramics in the vicinity of the ends of the jet tube. The additional ring disks provide the ends of the combustion space.

They serve as thermal insulation. They may be made from porous aluminium oxide ceramics which, however, do not have breakthroughs.

The flame-stabilisation means can also be made from a three-dimensional metal mesh, a porous ceramic material or similar. In any case, it is useful when the jet tube has a Péclet number of <65 and the flame-stabilisation means has a Péclet number of >65. This reliably prevents backfiring of the flame in the jet tube. At the same time, combustion in the flame-stabilisation means is possible.

In a particularly advantageous embodiment feature, the flame-stabilisation means is surrounded by a heat exchanger. The heat decoupled from the flame-stabilisation means is transferred with high efficiency to a fluid medium circulating in the heat exchanger. The heat exchanger can be surrounded by a housing.

The invention will now be described in more detail using an example based on the drawing.

DETAILED DESCRIPTION OF THE INVENTION

Figure 1:
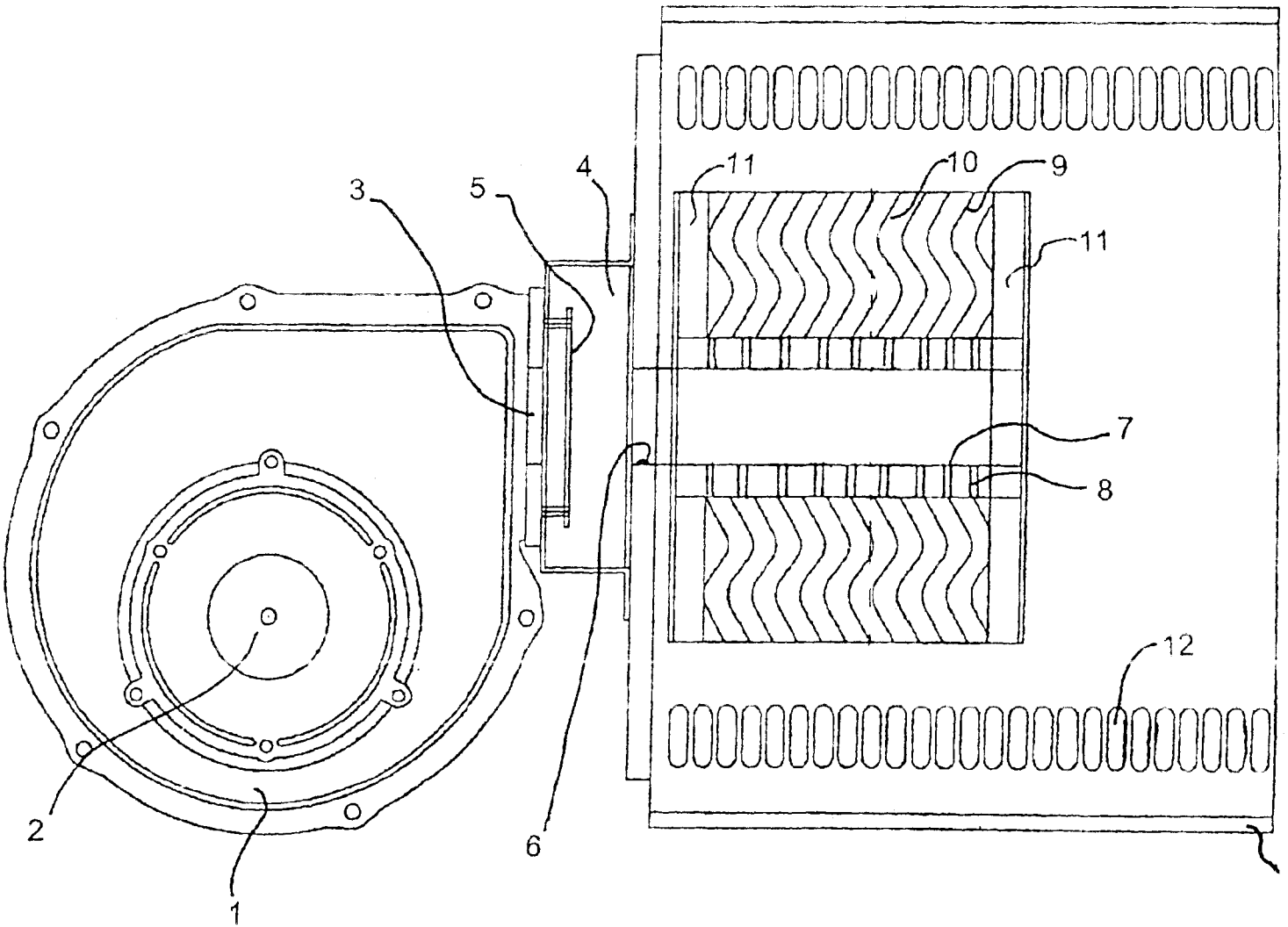
FIG. 1 A schematic side view of a burner.

In FIG. 1 an inlet 2 for a gas/air mixture is provided in a housing half-shell 1 of a blower not shown in detail here. A blower outlet 3 is located across from a deflector 5 installed in a advance chamber 4. The function of the deflector 5 is to ensure as homogenous a current flow speed as possible at inlet cross section 6 of a jet tube 7. Jet tube 7 has a plurality of radial breakthroughs 8 with a diameter of approximately 1.0 to 2.0 mm. Breakthroughs 8 are distributed uniformly over the jacket surface of jet tube 7.

The exterior jacket surface of the jet tube 7 contains ring disks 9 which are preferably rippled in cross section. The ring disks 9 are spaced axially from each other. Current flow canals 10 are present between two adjacent ring disks 9. In the vicinity of the ends of the jet tube 7 are additional ring disks 11 on the exterior jacket surface of the jet tube 7. The additional ring disks 11 are made of a thermal-insulating ceramic material, e.g., a very porous aluminium oxide ceramic material. They have no breakthroughs. The additional ring disks 11 limit a combustion space containing the ring disks 10 in axial direction. Designation 12 indicates tubes of a heat exchanger. The tubes 12 and the jet tube 7 with ring disks 9 and 11 are located in a common housing G.

Figure 2:
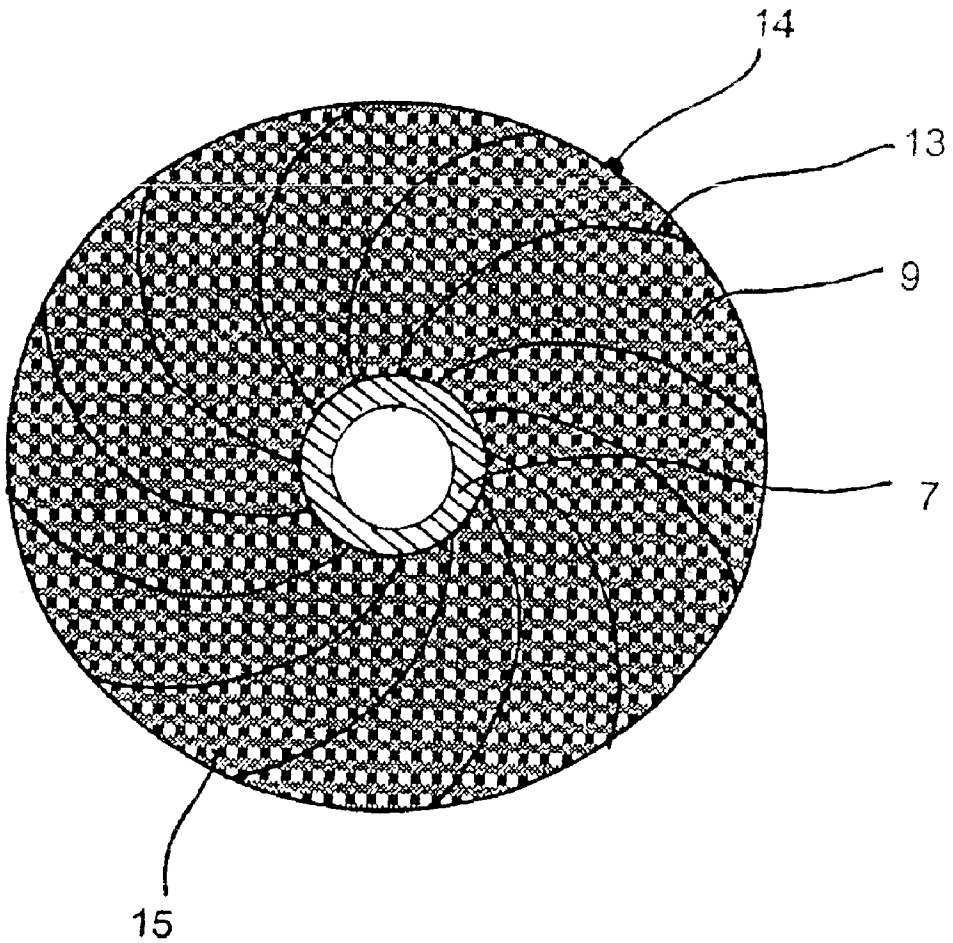
FIG. 2 A view of the top of a ring disk in accordance with FIG. 1.

FIG. 2 shows a view of the top of a ring disk 9 which is located on the jet tube 7. The ring disk 9 is made of a ceramic material with a mesh-type structure. Such a ceramic material can be made by impregnating a textile made of mullite fibers with an aluminium oxide slurry by sintering the impregnated mullite fiber compound after the slurry dries. The additional breakthroughs created by this are designated as 15. It has proven particularly useful to design the surface of the ring disk 9 as rippled. The wave crest lines are suggested in FIG. 2 with the designation 13. They run from the jet tube 7 bent towards the circumference edge 14 of ring disk 9 so that a paddle wheel type structure is created. It is advantageous when the ring disks 9 each have an odd number of wave crest lines 13. When such ring disks 9 are arranged in succession so that their wave crest lines 13 are positioned in axial succession, current canals 10 are created whose cross section increases from the jet tube 7 to the circumference edge 14. Such current canals 10 make it easier to discharge the expanding, hot combustion gases. Particularly efficient combustion as well as effective heat decoupling are achieved.

The ring disks 9 can also be made of fleece made of a mullite fibers. The fleece is stable in shape. It can be made by pressing mullite fibers. The shape is designed so that the ring disks are rippled. The required breakthroughs which may be in the form of holes or slits can be made by blocking. The form-stable mullite fleece is impregnated with an aluminium oxide slurry, dried and then sintered. This produces a stable-shaped, heat resistant ring disk with the desired form.

With a further embodiment feature, the ring disks can also be provided with a catalytically effective coating. Such a coating may contain lead, platinum or other suitable metals. A burner with such catalytically coated ring disks has particularly low emission values.

Figure 3:
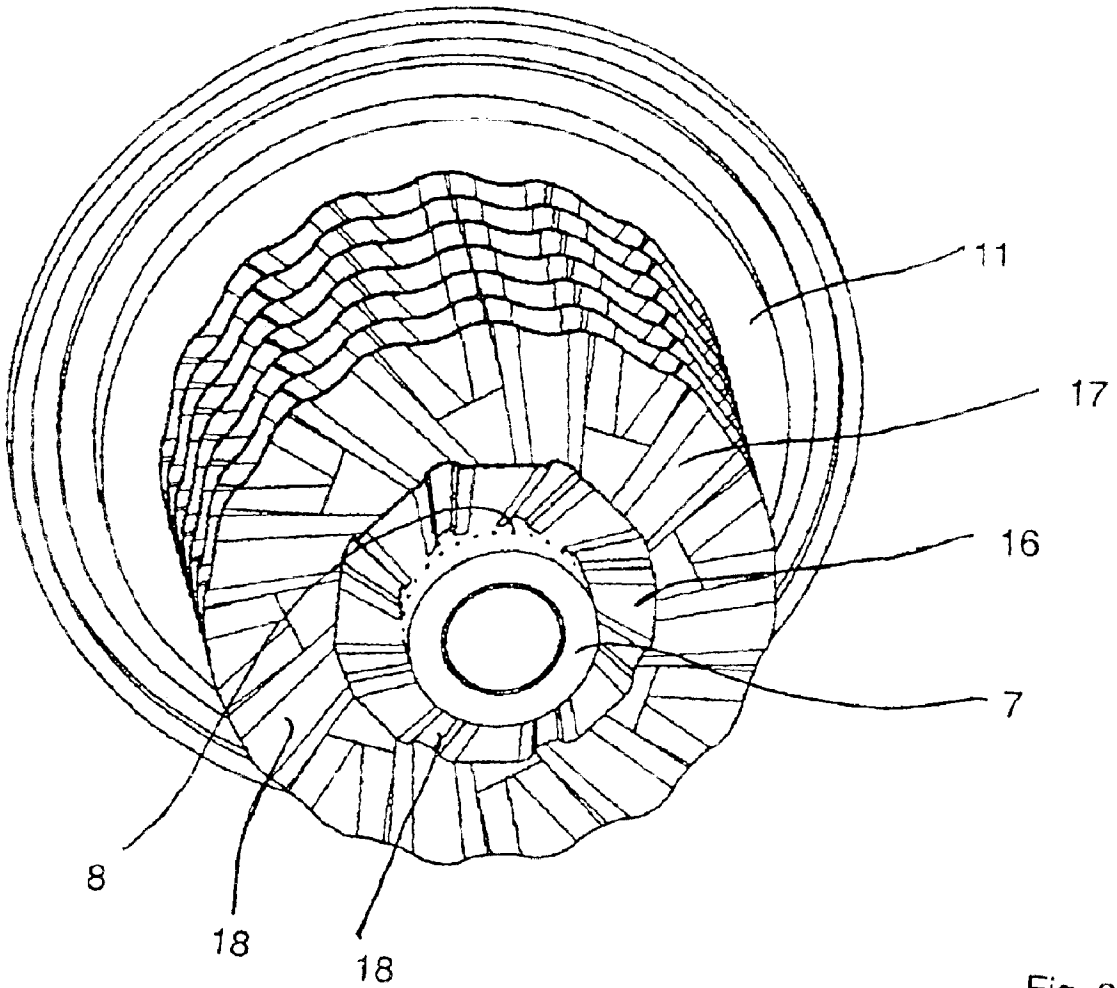
FIG. 3 A perspective view of a burner.
Figure 5:
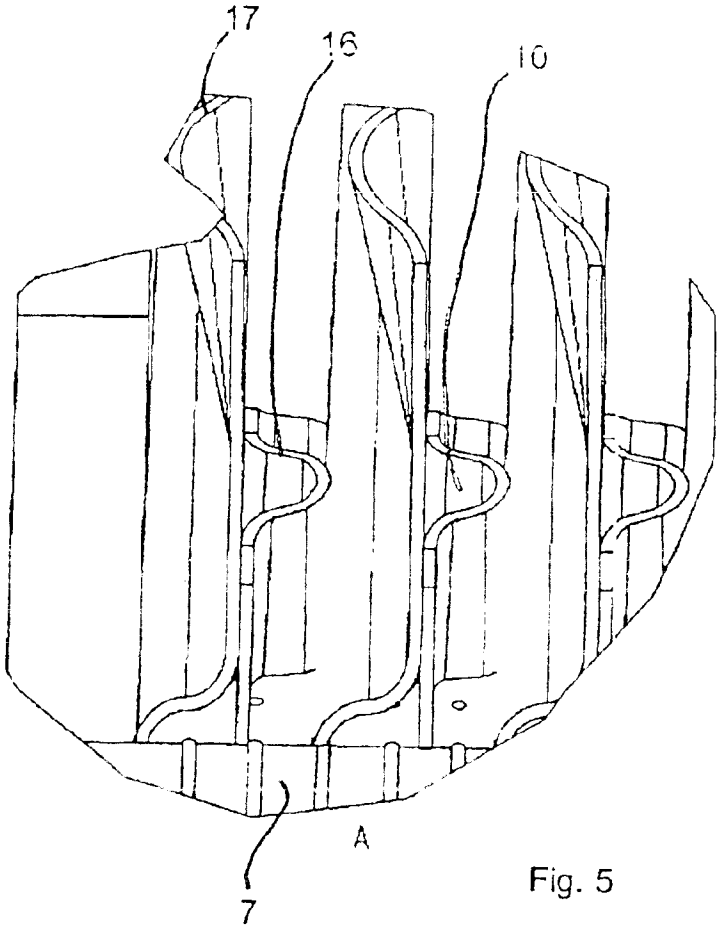
FIG. 5 A detail view of FIG. 4.
Figure 4:
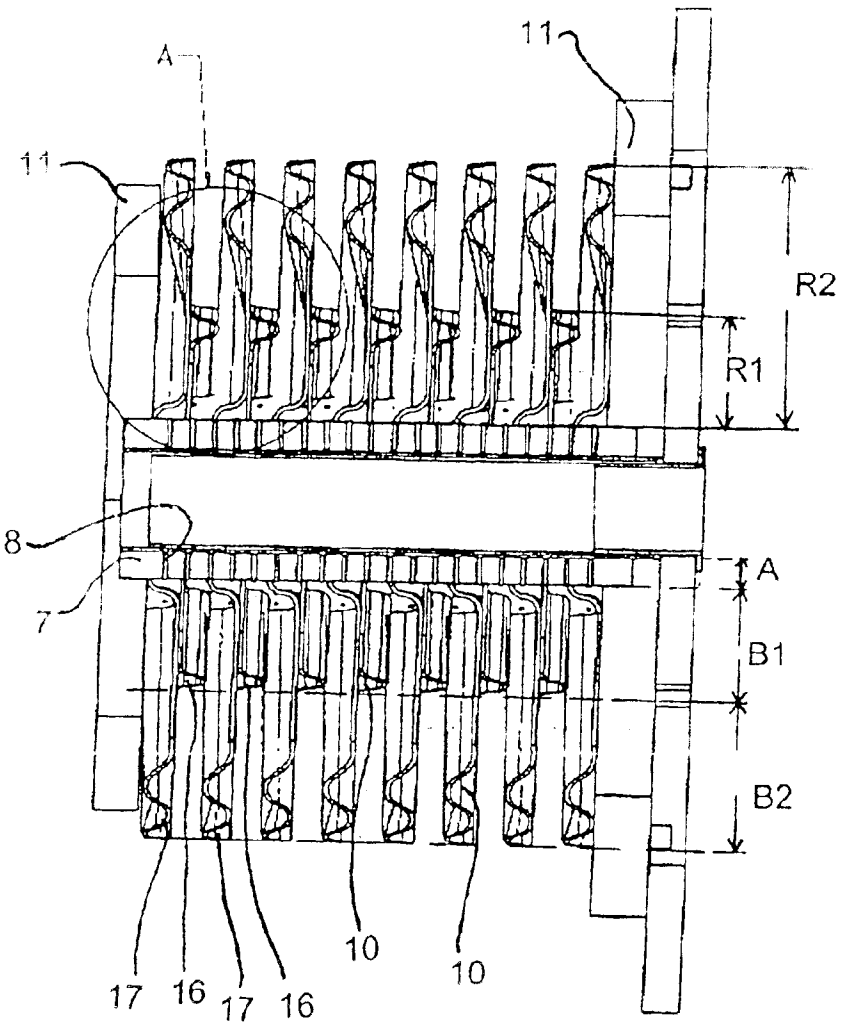
FIG. 4 A cross sectional view of FIG. 3.

FIGS. 3 to 5 show a further embodiment of a burner. First ring disks 16 and second ring disks 17 are located on the jet tube 7. The first ring disks 16 and the second ring disks 17 have ripples 18 radially slanted to the outside. The ripples 18 create current flow canals 10 whose cross section expands radially from the inside to the outside. A ring radius R1 of the first ring disks 16 is approximately half as large as a ring radius R2 of the second ring disks 17. In this context, the term "ring radius" is used to mean the difference between an inner radius and an outer radius of the ring disk. For an explanation, see FIG. 4 in which the ring radiuses R1 and R2 are shown.

As shown in FIG. 4, the alternating succession of the first ring disks 16 with the second ring disks 17 creates a first flame-stabilisation zone B1. The ring sections of the second ring disks 17 extending over the first flame-stabilisation zone B1 create a radial outer second flame-stabilisation zone B2. A Péclet number of a zone A created by jet tube 7 is <65. This ensures that flames will not backfire in the jet tube 7. A Péclet number of flame-stabilisation zones B1, B2 is >65, wherein the Péclet number of the second flame-stabilisaton zone B2 is greater than the Péclet number of the first flame-stabilisation zone B1.

With the burners provided by the invention, combustion takes place in the flame-stabilisation means created by ring disks 9, 16 and 17. No flames appear on the surface surrounding the flame-stabilisation means. The suggested burner has excellent dynamics, i.e., it can be modulated in a larger area than the volume or surface burners known up to now.

The flame-stabilisation means can also be created from spirally arranged areas radially from the jet tube. It can also be in the form of turbine blade type or paddle wheel type ring disks.

REFERENCE DESIGNATION LIST

1 Blower half-shell
2 Inlet
3 Blower outlet
4 Advance chamber
5 Deflector
6 Inlet cross section
7 Jet tube
8 Breakthrough
9 Ring disk
10 Current canal
11 Additional ring disk
12 Tube
13 Wave crest line
14 Circumference edge
15 Additional breakthroughs
16 First ring disk
17 Second ring disk
18 Ripple
A Zone
B1 First flame-stabilisation zone
B2 Second flame-stabilisation zone
R1 First ring radius
R2 Second ring radius
G Housing

What is claimed is:

1. A burner for a gas/air mixture with an inlet (2, 6) for a gas/air mixture, wherein a jet tube (7) is located downstream of the inlet (2, 6), the jet tube (7) having a jacket surface with a plurality of breakthroughs (8), wherein a zone A created by the jet tube (7) has a Péclet number that prevents flames from backfiring in the jet tube (7), and wherein the jet tube (7) is surrounded radially by means (9, 16, 17) for stabilizing the flame consisting of a plurality of ring disks (9, 16, 17) arranged radially from the jet tube (7) and spaced at an axial distance from each other.

2. The burner as defined in claim 1, wherein combustion of gas takes place primarily in the flame-stabilizing means (9, 16, 17).

3. The burner as defined in claim 1, wherein a blower to transport the gas/air mixture into the jet tube (7) is located after the inlet (2).

4. The burner as defined in claim 1, wherein the jet tube (7) is made from a fireproof ceramic material.

5. The burner as defined in claim 4, wherein the fireproof ceramic material has a porosity of 75 to 95 vol. %.

6. The burner as defined in claim 1, wherein the flame stabilizing means is created from foam ceramic material.

7. The burner as defined in claim 1, wherein the ring disks (9, 16, 17) are created from first (16) and second ring disks (17), and wherein a ring radius (R1) of the first ring disks (16) is smaller than a ring radius (R2) of the second ring disks (17).

8. The burner as defined in claim 7, wherein the ring radius (R1) of the second ring disks (17) is at least twice as large as the ring radius (R1) of the first ring disks (16).

9. The burner as defined in claim 7, wherein the first (16) and the second ring disks (17) are placed alternately on the jet tube (7) in the axial direction.

10. The burner as defined in claim 9, wherein the alternating succession of the first (16) and the second ring disks (17) creates a first flame-stabilisation zone (B1) located radially inside as well as a second flame-stabilisation zone (B2) located radially outside without first ring disks (16) in between.

11. The burner as defined in claim 10, wherein the Péclet number of the first flame-stabilisation zone (B1) is less than the Péclet number of the second flame-stabilisation zone (B2).

12. The burner as defined in claim 7, wherein a surface of the ring disks (9, 16, 17) is rippled so that current flow canals (19) are created between two adjacent ring disks (9, 16, 17) from the jet tube (7) to an outside circumference edge (14) of the ring disks (9, 16, 17).

13. The burner as defined in claim 12, wherein wave crest lines (13) of the ripples (18) run from a center to the outside circumference edge (14) of the ring disks (9, 16, 17) so that continuous current flow canals (10) are created between two adjacent ring disks (9, 16, 17) from the jet tube (7) to the outside circumference edge (14).

14. The burner as defined in claim 13, wherein a cross section of the current flow canals (10) increases radially from an inside to the outside.

15. The burner as defined in claim 13, wherein the Péclet number in the flame stabilizing means increases radially towards the outside.

16. The burner as defined in claim 12, wherein the surface of the ring disks (9, 16, 17) has a plurality of additional breakthroughs (15).

17. The burner as defined in claim 7, wherein the ring disks (9, 16, 17) are made from a fireproof ceramic material.

18. The burner as defined in claim 16, wherein the ceramic material is created from mullite fibers on an aluminium oxide matrix.

19. The burner as defined in claim 7, wherein the ring disks (9, 16, 17) are arranged between two additional, fireproof ceramic ring disks (11) located in a vicinity of ends of the jet tube (7).

20. The burner as defined in claim 1, wherein the jet tube (7) has a Péclet number of <65 and the flame stabilizing means (9, 16, 17) has a Péclet number of >65.

21. The burner as defined in claim 1, wherein the flame stabilizing means (9, 16, 17) is surrounded by a heat exchanger (12).

* * * * *